US008251118B2

(12) United States Patent
Loar

(10) Patent No.: US 8,251,118 B2
(45) **Date of Patent: *Aug. 28, 2012**

(54) COMBINATION WINDOW SHUTTER FOR FIRE AND SHADE

(76) Inventor: Ronald J. Loar, Berkeley, CA (US)

( * ) Notice: Subject to any disclaimer, the term of this patent is extended or adjusted under 35 U.S.C. 154(b) by 32 days.

This patent is subject to a terminal disclaimer.

(21) Appl. No.: 12/884,066

(22) Filed: Sep. 16, 2010

(65) Prior Publication Data

US 2011/0083813 A1 Apr. 14, 2011

Related U.S. Application Data

(60) Provisional application No. 61/277,257, filed on Sep. 21, 2009.

(51) Int. Cl.
*E05F 15/20* (2006.01)

(52) U.S. Cl. ..... 160/9; 160/7; 160/1; 160/133; 160/309

(58) Field of Classification Search ..... 160/1, 7, 160/9, 133, 238, 309, 291, 305
See application file for complete search history.

(56) References Cited

U.S. PATENT DOCUMENTS

| | | | | | |
|---|---|---|---|---|---|
| 827,676 | A * | 7/1906 | Vance | 160/232 |
| 1,369,518 | A * | 2/1921 | Bumbarger | 160/1 |
| 1,474,345 | A * | 11/1923 | Bumbarger | 160/305 |
| 1,594,819 | A * | 8/1926 | Deller | 160/9 |
| 1,617,439 | A * | 2/1927 | Duncanson | 160/8 |
| 1,617,440 | A * | 2/1927 | Duncanson | 160/9 |
| 1,708,377 | A * | 4/1929 | Cornell | 160/9 |
| 1,718,752 | A * | 6/1929 | McCloud | 160/9 |
| 1,968,719 | A * | 7/1934 | Smurr | 160/133 |
| 2,528,869 | A * | 11/1950 | De Laney | 160/7 |
| 2,564,208 | A * | 8/1951 | Michelman | 160/9 |
| 2,946,377 | A * | 7/1960 | Zoll et al. | 160/8 |
| 3,173,475 | A * | 3/1965 | Wegner | 160/133 |
| 3,559,716 | A * | 2/1971 | Loucks | 160/9 |
| 4,147,197 | A * | 4/1979 | Bailey et al. | 160/7 |
| 5,022,452 | A * | 6/1991 | Burrell | 160/7 |
| 5,226,467 | A * | 7/1993 | Lii | 160/302 |
| 5,253,693 | A * | 10/1993 | Marlatt et al. | 160/7 |
| 6,123,134 | A * | 9/2000 | Thomas et al. | 160/8 |
| 7,878,230 | B2 * | 2/2011 | Daus et al. | 160/9 |
| 2008/0087385 | A1 * | 4/2008 | Clauss | 160/133 |

* cited by examiner

*Primary Examiner* — Katherine W Mitchell
*Assistant Examiner* — Johnnie A Shablack
(74) *Attorney, Agent, or Firm* — Thomas M. Freiburger

(57) ABSTRACT

The present invention is a device that provides protection for a window from exterior fires which might ignite combustibles by radiation through the glass and/or break the glass and allow direct flame impingement, and also operates as a non-solid shutter or shade allowing privacy and shade. The shutter consists of metal or other noncombustible screen, mesh or slats spaced or pierced so that they allow some light to penetrate for shade control but protect the window glass from heat radiation and flying debris created by an external firestorm. The shutter can be raised and lowered manually, or with mechanical assistance, as by means of a chain lift or other roll-up/down mechanism for shade and privacy control, but will drop (close) automatically when released by a fusible link of the appropriate temperature setting to provide the fire protection. The unique features of the invention are the spacing of the slats, mesh or screen openings, sized to interrupt the coherent passage of heat radiation waves, and a mechanism to override manual operation so that shutter will automatically close during a fire.

7 Claims, 2 Drawing Sheets

COMBINATION WINDOW SHUTTER FOR FIRE AND SHADE

This application claims benefit of provisional application No. 61/277,257, filed Sep. 21, 2009.

BACKGROUND AND SUMMARY OF THE INVENTION

This invention concerns fire protection, and specifically is directed to a combination window shutter which allows some light to pass through when extended over a window, thus useful as a typical sun or privacy screen, but the shutter or shade being so constructed that when exposed to an exterior fire or firestorm while retracted it will automatically drop, covering the window, and prevent the passing of radiation sufficient to ignite most combustibles or cause the window glass to break. Further, it will protect the window from the impact of flying debris which is often created by a fire storm.

Other fire shutters have been constructed of a plurality of elongated slats interconnected together with a plurality of hinges to form a solid screen with virtually no possible passage of light, similar to the standard industrial roll-up door. They are not suitable for use as a sun screen. Further, they tend to be heavy and industrial in appearance. This invention, by allowing some light to pass through the shutter and also being much lighter in construction, can serve the combined purpose of a shade or privacy screen and a fire shutter. The means in which this is accomplished is that the spaces between slats, mesh screen wire, or other elements is sufficiently small so that they block the passage of a significant portion of the radiant waves. Further, the mechanism which automatically closes the shutter during a fire must be able to override manual operation. This can be done by means of a clutch arrangement which is disengaged (released) by a temperature actuated fusible link or other means at a temperature appropriately associated with an exterior fire, such as a wild fire, local vegetation or debris fire, or a close burning building, etc. The mechanism allows the shutter to close automatically (drop, in free fall) by gravity.

The key elements are the shutter with limited size openings and the clutch that can be disengaged at an appropriate temperature by fusible links or other means; the former constructed of slats strung on a cable or of mesh screen or other material, essentially fireproof or fire resistant, having openings small enough in at least one dimension to block much of the passage of radiant heat.

When used as a sun or privacy screen, the shutter would be raised and lowered manually by conventional means, such as chain lift, crank, gear driven mechanism, electric motor or other. The raising mechanisms and holding ratchets, brackets, drum on which the shutter is wound, tension spring and bearings are all of common design and use, and do not alone form a part of this invention. The details of these components may be modified from those shown to facilitate fabrication, reliability, cost, appearance or for other reasons.

Thus, the present invention provides a combination window shutter and fire protection screen which allows some light to pass through when extended over a window, thus serving as a typical sun or privacy screen, but which is so constructed that it can also automatically function as a barrier to radiant energy and flying debris generated by an exterior fire which might otherwise ignite combustibles, such as curtains and upholstered furniture just inside the window or break the glass and allow direct flame entrance. The mechanisms are simple and reliable, most having been used countless times in other applications. The uniqueness of this invention is in the nature of the shutter itself, which allows it to perform more than one function in an inexpensive, attractive and practical way, and the mechanism which allows it to be activated automatically during a fire.

DESCRIPTION OF PREFERRED EMBODIMENTS

Drawing Elements

Figure 1A:
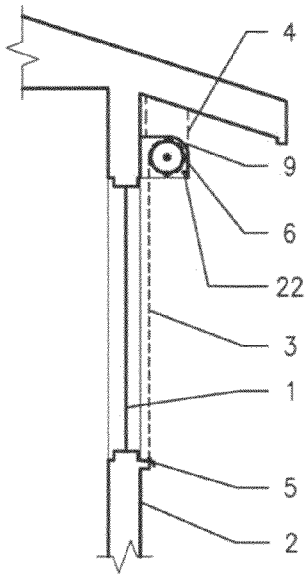
FIG. 1A is a sectional elevation view of a building with a fire protective window shade of the invention installed at a window.
Figure 1B:
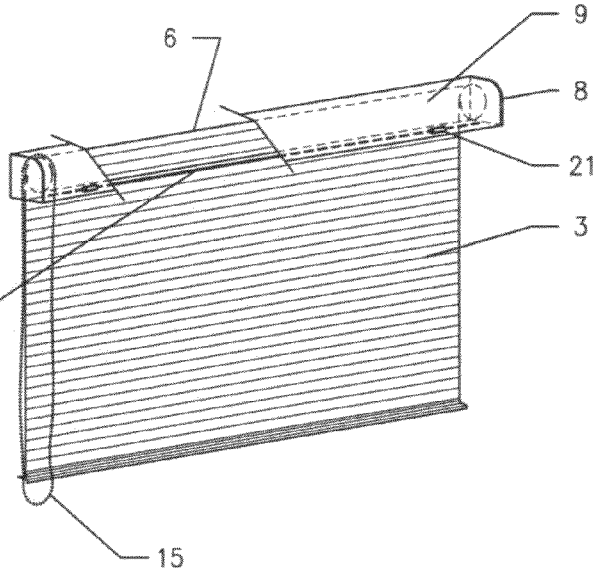
FIG. 1B is a perspective view showing the fire protective window shade.

FIGS. 1A and 1B:

1. Window being protected.
2. Building, exterior face.
3. Combination fire/shade shutter over window—can be mounted on wall or hung from above, and constructed of noncombustible slats or screen (see FIGS. 2A and 2B for details).
4. Eave hung option.
5. Sill closure piece of noncombustible material (optional).
6. Drum on which shutter is rolled. For mechanism to manually raise and lower shutter and for fusible link(s) and mechanism to automatically lower shutter during a fire, see FIG. 3.
8. Steel mounting brackets each end of assembly for mounting on building.
9. Sheet metal cover (see FIG. 3 for details).
21. Fusible links (a standard commercial product).
22. Stainless steel tension cable with two fusible links (item 21).

Figure 2A:
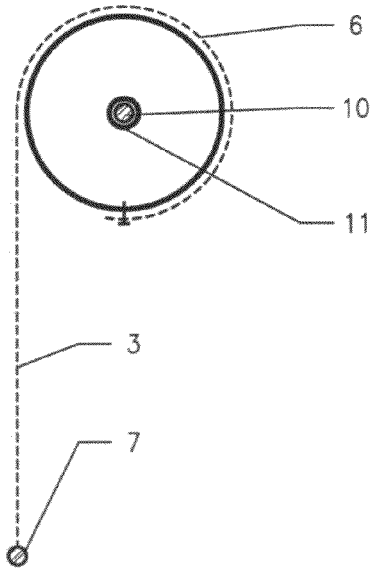
FIG. 2A is a sectional elevation view showing the window shade on a roll-up drum with the shade partially unrolled.
Figure 2B:
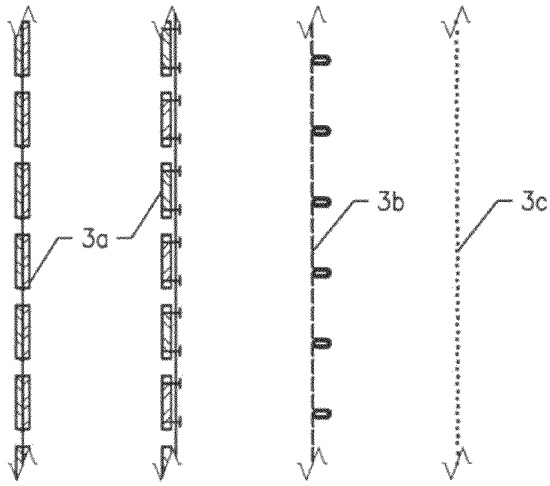
FIG. 2B is a detail view in elevational section showing examples of fire protective window shades that can be included in the invention.

FIGS. 2A and 2B:

3. Detail of shutter with articulated slats of metal or other noncombustible material strung on stainless steel cables and spaced with steel bead spacers or other means. (see items 3*a*). When shutter is down, space between slats shall be small enough to block a significant portion of the radiation, estimated at 1/16", or preferably within range of 1 to 2.5 mm, blocking a significant portion of infrared radiation. It is believed the openings (at least in one dimension) should be on the order of magnitude of the wavelength of infrared radiation typically transmitted in a wild fire or house fire, even though the opening size will usually be greater than that wavelength. In any event, a shutter that is only about 20% open, or even up to 50% or so open, will block a significant portion of the radiation so as to greatly lessen the radiant heat transferred. The shutter may also be of pierced slats, wire mesh screen or other noncombustible and heat-resistant material in lieu of the solid slats (see items 3*b* and 3*c*).

6. Detail of steel drum with shutter attachment. Drum diameter will vary depending on size of window and design considerations (see FIG. 3 for details).

7. Weighted bottom edge of shutter to ensure shutter drops by gravity when released by fire-actuated fusible links.

10. Preferably solid steel shaft affixed to brackets each end so shaft does not turn (see FIG. 3 for details).

11. Tube shaft over solid shaft and prevented from turning by teeth (item 20) except when released by tension cable with fusible links (see FIG. 3 for details).

FIG. 3:

6. Drum on which shutter is rolled.

8. Steel mounting brackets each end of assembly for mounting on building.

9. Sheet metal cover with 'keeper' to keep lifting chain from coming off cogged wheel/pulley.

10. Solid shaft affixed to brackets to prevent rotation.

11. Tube shaft over solid shaft and prevented from turning by teeth (item 20) except when released by tension cable/fusible links to move axially left and disengage.

12. Drum bearings at each end of drum.

13. Tension spring to counterbalance weight of shutter during manual use, as in a roll-up window shade.

14. Cogged wheel/pulley for lifting chain when raising or lowering shutter manually.

15. Chain to operate shade.

16. Ratchet teeth and stops for holding shutter at desired height (similar to mechanism used for pull-down window shade).

17. Bearing disk connected to portion of tube shaft acting as thrust bearing; tube shaft can rotate when released by tension cable with fusible links.

18. Lever arm connected to tension cable at one end and having pressure disk 18*a* at other end.

19. Bracket with pin for bearing plate pivot.

20. Teeth to keep tube shaft (item 11) from turning except when released by tension cable and fusible links.

21. Fusible links (a standard commercial product) which melt and release tension cable 22 at appropriate temperature within range of about 200° to 500° F.

22. Stainless steel tension cable with two fusible links.

Figure 3:
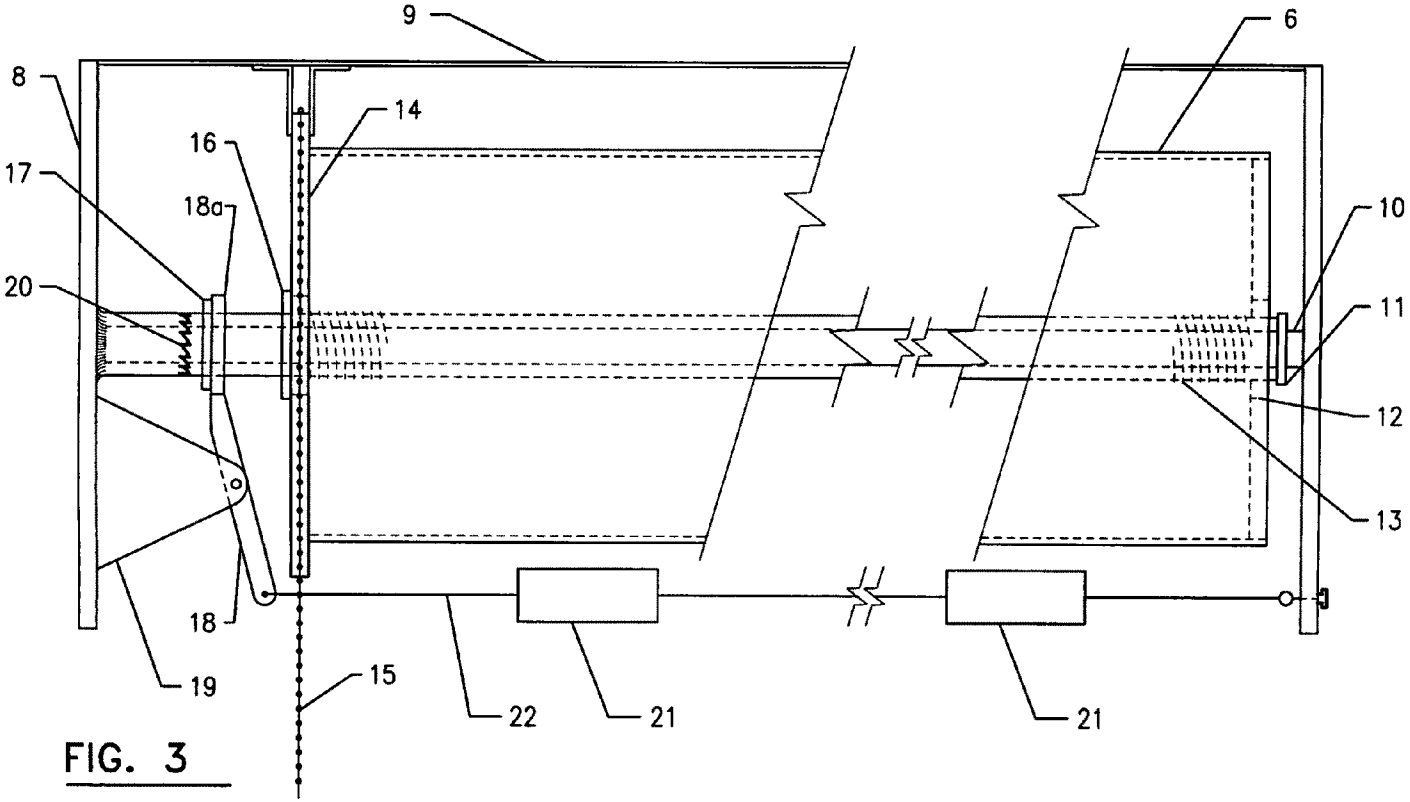
FIG. 3 is a frontal elevation view, partially schematic and partially in section, showing an example of a release mechanism.
Figure 4:
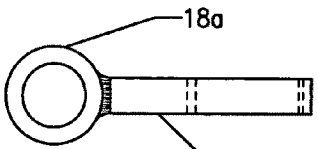
FIG. 4 is a view showing a lever arm with a pressure bearing.

Description of Operation:

The illustrated assembly is one example of how the invention can be carried out. In this example, the tension cable 22 holds the lever arm 18 in a position such that the bottom of the lever arm as seen in FIG. 3 is held to the right and the bearing disk or thrust bearing 17 is held to the left by the pressure disk 18*a*, in the position shown in the drawing. This keeps the teeth 20 of the tube shaft 11 engaged and thus the tube shaft 11 fixed against rotation. In the event of a fire adjacent to the building, producing sufficient heat to raise the temperature of either or both of the fusible links 21 to a preset triggering temperature, the cable 22 will no longer hold the bearing disk 17 and the tube shaft 11 in place with the teeth 20 engaged as shown in FIG. 3. The tube shaft 11, normally fixed in place and relative to which the drum 6 rotates when the shade is raised or lowered, is permitted axial movement to the right and frees itself from the teeth 20 due to the inclined surfaces of the teeth as shown and becomes freely rotatable, so the entire drum can rotate freely along with the tube shaft 11. In this way the shade's torsion roll-up spring 13 does not come into play and the shade can unroll in a free fall by gravity, especially with the weighted bottom edge 7 assisting in unrolling of the shade. Note that other types of rotation brakes than the teeth arrangement illustrated could be used, such as a simple friction brake with a friction pad against a plate. A spring can be included (not shown) urging the shaft 11 toward disengagement from the rotation brake.

If the chain pull 15 is included, this will simply rotate freely as well. Note that with the pull-down shade mechanism as illustrated, including the torsion spring 13 and the ratchet teeth 16 (as in a conventional window shade), such a chain pull 15 is not necessary, but a simple handle or chain could be included at the bottom edge of the shade if desired. The torsion spring can effect the raising of the shade when this is initiated by an operator, as in a typical window shade.

Other releasable retaining devices and mechanisms for releasing the shade are possible, and the invention is not limited to the fusible link and bearing disk arrangement shown. For example, a fusible link could consist of a pin between an inner shaft such as the tube shaft 11 which is normally held fixed, and any other fixed structure. In that way, the fusible link pin would be subjected to heat and would break, and the tube shaft 11 could then freely rotate on the inner, solid shaft 10, so that the drum releases the shade by gravity. In another form of the shade without a torsion spring 13, but with a mechanical chain such as shown at 15 to both raise and lower the shade, the chain 15 or the pulley 14 would be latched in some way when the shade is in the retracted, raised position. A fusible link could be located between the drum 6, at the left end of the drum as seen in FIG. 3, and the pulley 14, thus normally linking the drum to the pulley 14. The fusible link would be exposed to the heat of a fire, and would be caused to fail by the heat of the fire, releasing the drum 6 from the shade raising mechanism, i.e. from the pulley 14. Other arrangements involving fusible links, heat-responsive or alarm-activated electric solenoid, etc. are also possible and within the scope of the invention.

The terms drum and roller as used herein are to be broadly interpreted, not necessarily requiring a hollow drum. Further, the term shade is to be understood as meaning shade or shutter. Also, the term window is to include a glass door or a door that includes glass.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A window shade or shutter hung adjacent to a window of a building, comprising:

a retractable shade sufficiently wide to essentially cover the window and capable of being stored in a roll, a roll-up drum to which an upper end of the retractable shade is secured, and including drum support connected to the building and supporting the drum for rotation on a horizontal axis, the shade having openings of limited size allowing some light to enter through the window from outside the building, the shade being of fireproof or fire resistant material, a user-accessible mechanism for raising the shade in normal use of the window shade to reduce light entering through the window, by rotating the drum to roll the shade up on the drum, and for lowering the shade, retaining means associated with the mechanism for normally retaining the shade in a position as set by the mechanism, and the retaining means including a fusible link such that when the fusible link breaks by reaching a preselected temperature from proximity of a fire the retaining means will be released so as to allow the window shutter when in a raised position to drop in free-fall from gravity unrestrained by the mechanism or the retaining means, to a lowered position protecting the window.

2. The window shade of claim 1, wherein the openings of the shade occupy about 20% to 50% of the shade.

3. The window shade of claim 1, wherein the retractable shade comprises a series of horizontal slats with said openings extending horizontally between slats, the openings between slats having a height in the range of 1 to 2.5 mm, whereby the slats block a significant portion of infrared radiation from a fire.

4. The window shade of claim 1, wherein the drum is a hollow drum, and including a shaft passing through and concentric with the drum, the shaft being mounted for rotation on the building but normally held against rotation by a rotation brake, and the drum being rotatable on the shaft for normal lowering and raising of the shade, and including a lever arm pivotally mounted on a bracket fixed relative to the building and positioned to normally urge the shaft in an axial direction into engagement with the rotation brake with a tension line connected to the lever but to release the shaft from the rotation brake when the fusible link, included in the tension line, has been broken by heat, releasing the tension line and the rotation brake and allowing the shaft and the drum along with the shaft to rotate freely.

5. The window shade of claim 4, wherein the rotation brake comprises teeth on an end of the shaft, normally engaged with teeth fixedly secured relative to the building, preventing rotation of the shaft except when the teeth are disengaged by axial movement of the shaft.

6. The window shade of claim 1, wherein the drum is supported by a shaft coaxial with the drum, the shaft being mounted for rotation on the building but normally held against rotation by a rotation brake, and the drum being rotatable relative to the shaft for normal lowering and raising of the shade, and the retaining means including a tension line connected to the rotation brake and normally holding the rotation brake engaged, the fusible link being included in the tension line such that when the fusible link has been broken by heat, the tension line is released, releasing the rotation brake and allowing the shaft and the drum along with the shaft to rotate freely.

7. The window shade of claim 6, including a plurality of fusible links in the tension line, at positions to be directly exposed to a fire adjacent to the building.

* * * * *